US008682511B2

(12) United States Patent
Andreasson

(10) Patent No.: US 8,682,511 B2
(45) **Date of Patent: *Mar. 25, 2014**

(54) METHOD FOR PLATOONING OF VEHICLES IN AN AUTOMATED VEHICLE SYSTEM

(75) Inventor: Ingmar Andreasson, V Frolunda (SE)

(73) Assignee: POSCO (KR)

( * ) Notice: Subject to any disclaimer, the term of this patent is extended or adjusted under 35 U.S.C. 154(b) by 623 days.

This patent is subject to a terminal disclaimer.

(21) Appl. No.: 12/994,547

(22) PCT Filed: May 26, 2009

(86) PCT No.: PCT/KR2009/002788

§ 371 (c)(1),
(2), (4) Date: Apr. 13, 2011

(87) PCT Pub. No.: WO2009/145552

PCT Pub. Date: Dec. 3, 2009

(65) Prior Publication Data

US 2011/0184596 A1 Jul. 28, 2011

(30) Foreign Application Priority Data

May 26, 2008 (KR) ..... 10-2008-0048864

(51) Int. Cl.
*B61L 27/04* (2006.01)

(52) U.S. Cl.
USPC ..... 701/19; 701/22; 701/23; 701/27; 701/93; 701/96; 701/301; 104/19; 104/20; 340/435; 340/436

(58) Field of Classification Search
USPC ..... 701/19, 22, 23, 27, 93, 96, 301; 340/435, 436
See application file for complete search history.

(56) References Cited

U.S. PATENT DOCUMENTS

| | | | | |
|---|---|---|---|---|
| 5,867,801 | A * | 2/1999 | Denny | 701/33.4 |
| 5,873,310 | A * | 2/1999 | Creissels et al. | 104/173.2 |
| 6,389,982 | B1 | 5/2002 | Evensen | |
| 6,810,817 | B1 | 11/2004 | James | |
| 2004/0225421 | A1 | 11/2004 | Wu | |
| 2005/0038575 | A1 | 2/2005 | Wu | |
| 2007/0137513 | A1 | 6/2007 | Lowson et al. | |

* cited by examiner

*Primary Examiner* — John Q Nguyen
*Assistant Examiner* — Kyung Kim
(74) *Attorney, Agent, or Firm* — The Webb Law Firm

(57) ABSTRACT

Disclosed is a method of increasing track capacity in an automated vehicle system, the automated vehicle system comprising a network of tracks along which vehicles are adapted to travel, the network comprising at least one merge point at which at least two up stream tracks merge to form a downstream track, at least one diverge point at which one upstream track diverges to form at least two down-stream tracks and a plurality of stations at which passengers may board and/or disembark from the vehicles; wherein the method comprises controlling vehicles so as to cause empty vehicles to travel as at least one sequence of vehicles defined as a platoon; and controlling the empty vehicles of the at least one sequence to travel with a first safety distance between each other, the first safety distance being shorter than a second safety distance between vehicles being at least partially loaded.

18 Claims, 6 Drawing Sheets

METHOD FOR PLATOONING OF VEHICLES IN AN AUTOMATED VEHICLE SYSTEM

TECHNICAL FIELD

This invention generally relates to increasing track capacity in automated vehicle systems, in particular so called Personal Rapid Transit systems (referred to as "PRT").

BACKGROUND ART

Personal rapid transit systems include small vehicles offering individual transport service on demand. This invention relates to automated vehicle systems such as personal rapid transit systems with vehicles travelling along tracks forming a network of stations, merges, and diverges interconnected by unidirectional links in the form of tracks. PRT vehicles may be constructed to be compact and light which in turn allows the PRT guide-way (track) structure to be light compared with conventional railroad systems such as conventional tramways or metro systems. Therefore, the construction cost of the PRT system is much lower than that of alternative solutions. A PRT system is more friendly to the environment, since it has less visual impact and generates low noise, and it does not produce local air pollution. Further, PRT stations can be constructed inside an existing building. On the other hand, since the headway/free distance between vehicles may be kept comparably short, the traffic capacity of a PRT system is comparable with the existing traffic means such as bus and tramway.

Stations are normally located off-line on sidetracks so that stopping vehicles do not hinder passing vehicles.

Vehicles in an automated vehicle system such as a PRT system are typically required to run with at least a minimum safe separation between vehicles. A common requirement is for the separation to be large enough so that if one vehicle comes to a sudden unexpected stop, the following vehicle can stop before it hits the standing vehicle.

The minimum safe separation for running vehicles in a track network depends on the speed of the vehicles, detection delay, brake application delay and acceptable braking rate. For vehicles running at 45 kph a safe separation or minimum time headway could typically be 2-3 seconds or 25-40 meter (front to front of vehicles).

The minimum safe separation/time headway between vehicles determines the capacity of a link/track, and if the minimum time headway is 3 seconds, the link capacity will then be 1200 vehicles per hour. Hence, the link/track capacity of a PRT system is therefore limited by the spacing requirements between vehicles. The present invention is concerned with increasing link/track capacity in PRT networks as well as in other networks where automated vehicles are travelling.

The guideway/track network of a PRT system generally comprises unidirectional links/tracks and nodes (so-called merges or merge points) where two or more upstream tracks merge to form a downstream track as well as nodes (so-called diverges) where an upstream track divides to form two or more downstream tracks. An important issue for vehicles approaching diverges is the choice of route, while important issues for vehicles approaching a merge is safety, efficiency, and comfort for passengers.

Generally, in a merge, two streams of vehicles come together and therefore a merge is also a potential bottleneck for capacity. Whatever flow can pass through a merge can pass freely through the downstream network until the next merge. Merge capacity is thus also dimensioning system capacity.

Generally a PRT system includes a control system for controlling speed and distance between vehicles. There are two main principles for vehicle control in PRT systems. With synchronous control vehicles are made to follow synchronously moving slots with constant time spacing, dimensioned to secure a safe distance at all permitted speeds in the network. Before a vehicle is allowed to depart from a station it is assigned a slot all the way to its destination. All bookings of merge passages need to be administered by a central computer. In a heavily loaded system, vehicles have to wait longer (taking up space) for a free slot, especially if its route passes through several merges. The usable capacity in a synchronous system is only about 65% of theoretical link capacity. Regarding safety, as long as all vehicles follow their assigned slots there should be no merge conflicts.

With asynchronous control, e.g. merge conflicts are resolved locally as in car traffic. Vehicles can depart from a station as soon as there is a free slot on the main track but they may have to slow down or even stop before going through a merge. Traffic through a merge is controlled by a local merge controller independent of central control. Congestion can be reduced by dynamic routeing avoiding merges which tend to be overloaded. Merge capacities can be utilised up to 100% and vehicles can be dynamically rerouted if necessary. Thus, generally asynchronous control provides an improved system capacity, routeing flexibility and robustness towards disturbances.

US 2004/0225421 describes a PRT system and a method of controlling movement of vehicles by means of a central control system, a wayside control system and a vehicle control system. When the wayside control system detects the identification of the approaching vehicle, the appropriate switch positions will be set and verified according to the traffic flow instruction from the central control system. This prior art document further describes that the vehicles can be coupled mechanically and electrically so as to form a train whereby capacity of the system is increased.

DISCLOSURE OF INVENTION

Technical Problem

However, such mechanical and electrical coupling requires a more complicated vehicle construction, as each vehicle needs to include suitable couplings. Furthermore, the coupling and uncoupling of vehicles is time-consuming and raises further safety issues.

It thus remains a problem to control vehicles in automated vehicle systems, such as PRT systems, for increasing track capacity in an efficient and cost-effective manner.

Disclosed is a method of increasing track capacity in an automated vehicle system, the automated vehicle system comprising a network of tracks along which vehicles are adapted to travel, the network comprising at least one merge point at which at least two upstream tracks merge to form a downstream track, at least one diverge point at which one upstream track diverges to form at least two downstream tracks and a plurality of stations at which passengers may board and/or disembark from the vehicles;

wherein the method comprises controlling vehicles so as to cause empty vehicles to travel as at least onesequence of empty vehicles; and controlling the empty vehicles of the at least one sequence to travel with a first safety distance between each other, the first safety distance being shorter than a second safety distance between vehicles being at least partially loaded.

For the purpose of the present description a sequence of vehicles of the same load status travelling with a reduced inter-vehicle distance, i.e. smaller than the safety distance for loaded vehicles, will also be referred to as a platoon.

Consequently, it is an advantage to bring together empty vehicles to run them in platoons, since platooning of vehicles will increase the track capacity, because two or more vehicles can travel with closer spacing on the tracks, than vehicles loaded with passengers can. By increasing track capacity in an automated vehicle system, it is possible to have more vehicles travelling on the tracks in the network, because the empty vehicles can travel in platoons, and more passengers can therefore be served because of the larger possible number of vehicles on the tracks.

The control system may treat vehicles individually when they are in a platoon, so that e.g. each vehicle is provided with its own speed command from the control system. Since the vehicles in a platoon are not physically connected, a splitting or division of a vehicle from the platoon does not depend on a physical disconnection which could introduce a safety hazard if the disconnection did not take place as planned.

Alternatively, the control system may treat vehicles collectively, i.e. treat the platoon as one entity or one vehicle, so that e.g. the vehicles in the platoon are provided with a collective speed command from the control system. However, a platoon may be equally long regardless of whether the vehicles in the platoon are controlled collectively or individually, and the length of the platoon may vary, when the platoon grows and/or splits up at merges and diverges, respectively.

The minimum safety distance between the last vehicle in the platoon and a following vehicle may be the same independent of platoon length. The distance headway measured from the front of the platoon to the front of the following vehicle may vary when the platoon grows and/or splits up, and this headway may be controlled. Alternatively, the headway distance may be measured from the front of the last vehicle in the platoon, as when vehicles are controlled individually, and then the headway distance may remain constant.

In one embodiment controlling the empty vehicles comprises dynamically forming said sequence of vehicles.

An advantage is that the formation of vehicles to run in platoons can be done dynamically, i.e. while the vehicles are travelling in the network of tracks, i.e. during a trip after dispatch from a station. On the contrary, static forming of platoons only comprises forming platoons by bringing together vehicles while vehicles are standing still at stations, in garages etc., and not while they are running as in dynamic formation of platoons. In dynamic formation of platoons, the distance between vehicles may be dynamically changed according to the load status of vehicles by means of a control unit, and this allows for effective distribution of vehicles in the network of tracks and increase of track capacity.

A further advantage of the present invention is that there is no mechanical or electrical coupling between the vehicles in a platoon, whereby time-consuming coupling operations are avoided. Furthermore, coupling operations may raise safety issues. Additionally, vehicles which are coupled mechanically or electrically require tracks which are long and straight enough between merges, diverges and/or stations for running a train of coupled vehicles. In the present invention, vehicles running in a platoon but not being coupled mechanically or electrically, can run much more flexibly and dynamically through merges, diverges and stations.

With rail switches, vehicles are directed through switches, e.g. diverges, by means of a mechanism at the rails, whereas with vehicle switches, vehicles are directed through switches by means of a mechanism in the vehicle. Rail switches require long headways between vehicles going in different directions, because the actual switch of rails takes some time. On the contrary, vehicle switches require in principle no headway between vehicles going in different directions, because the vehicles themselves perform the switch of rail e.g. by holding on to the rail going in the desired direction, and therefore no time for switching rails is necessary, when vehicles in a stream of vehicles are going in different directions at a diverge. Therefore with vehicle switches, it is possible to reduce the distance between the vehicles, also when the vehicles are going in different directions at a diverge, and platooning of vehicles is therefore enabled.

Another advantage in relation to the invention is that when increasing the link/track capacity of an automated vehicle system, such as a PRT system, the system is made feasible for areas with higher travel demand without the need for additional infrastructure.

The concept of platooning of vehicles as such is known from e.g. car traffic. However, platooning in car traffic relates to automation of transportation of vehicles, where the purpose of running vehicles in a platoon is to obtain easier and faster control and calculation of speed and direction of the running vehicles.

Empty vehicles are vehicles which do not carry any passengers. There is no personal risk for passengers when empty vehicles travel close together, since the safe spacing requirements between partially loaded vehicles serve to ensure the safety of riding passengers, but when a vehicle is empty, there is no need to satisfy these safe spacing requirements, as the platooning will not affect passenger safety in the vehicle system.

In automated vehicle systems it may often be the case that the demand for vehicles is larger at some stations at certain times during the day, e.g. stations in the center of a city may need to have many vehicles departing in the afternoon for transporting passengers from their work in the city to their homes in the suburbs, and vice versa in the mornings when passengers travel from their homes in the suburbs to the centre of the city. When the demand for vehicles is larger at some stations than at other stations, many empty vehicles must be transported to the busy departure stations from the arrival/descend stations. By running these empty vehicles in platoons with short spacing between the individual vehicles, the transportation of the empty vehicles will be executed faster than otherwise.

Technical Solution

There are several ways of bringing empty vehicles together in platoons, which will be described in embodiments of the present invention.

In one embodiment the method comprises assigning dispatch priorities to vehicles scheduled to be dispatched from a station, wherein dispatch priorities are assigned responsive to the load status of the vehicles.

An advantage of this embodiment is that e.g. a sequence of empty vehicles may be assigned with a higher dispatch priority, such that when empty vehicles are about to be dispatched from a station, where they are standing or have stopped, two or more empty vehicles can be dispatched together in a platoon, since there is no need to satisfy the safety spacing requirements, when there are no passengers in these vehicles. By dispatching more empty vehicles together, the track capacity is increased, since there can be more empty vehicles on the same track distance, when the vehicles are gathered in platoons with closer spacing between the vehicles.

In one embodiment the method comprises dispatching a sequence of at least two empty vehicles together in a platoon, the dispatching time being a scheduled dispatching time assigned to the front vehicle in the sequence of the at least two empty vehicles.

An advantage of this embodiment is that by dispatching more empty vehicles in a platoon at the dispatching time of the front vehicle, all the empty vehicles in the platoon will be dispatched sooner from the station than otherwise, which apart from increasing track capacity furthermore enables a faster distribution of vehicles in the network. Hence, the faster distribution may affect all vehicles in the network, and not only the empty vehicles travelling in the platoon, since a faster dispatching of empty vehicles from a station will enable a sooner dispatching of standing loaded vehicles waiting at the station, and this effect may furthermore affect the next vehicles entering the station by enabling these vehicles to enter the station sooner than otherwise, because the waiting vehicles may have dispatched from the station sooner than otherwise.

In one embodiment the stations may be linear stations, i.e. stations that only allow dispatch of vehicles in the same sequential order as the order of arrival of the vehicles at the station. Therefore the foremost vehicle standing at a station will be dispatched first from the station, and following vehicles may e.g. be dispatched together with the first vehicle.

In one embodiment the method comprises selecting an empty vehicle to be dispatched in a sequence of empty vehicles, as long as there are empty vehicles at the station to be dispatched.

An advantage of this embodiment is that by dispatching empty vehicles together from the station as long as there are empty vehicles standing at the station, a longer platoon of empty vehicles may be formed. As a consequence of this, at the same time loaded vehicles may be grouped in sequences only containing loaded vehicles, which may make passage through merge points, diverge points etc. more efficient, since fewer vehicles with different load status should be merged, diverged etc.

In another embodiment the method comprises selecting a loaded vehicle to be dispatched in a sequence of loaded vehicles, as long as there are loaded vehicles at the station to be dispatched.

In one embodiment, the method comprises assigning a path priority to a path at diverges at which more than one path leads to a destination of a vehicle, wherein assigning the path priority comprises assigning a higher path priority to a path responsive to a load status of respective previous vehicles travelling along the more than one path.

An advantage of this embodiment is that in a network of tracks there may be more than one route leading to the same destination and by assigning path priorities to paths according to the load status of vehicles travelling on the paths, it is possible to assign, for example, a higher path priority to a path where most travelling vehicles are empty, and thereby it is possible to control that an empty vehicle in front of a diverge is made to travel on the path where most travelling vehicles are also empty. By running empty vehicles on the same tracks of the network and thereby using the same network path, it is possible to obtain platooning of the vehicles, which will increase track capacity.

Furthermore, longer and longer platoons of empty vehicle will be formed each time one platoon running on one upstream track passes a merge point and merges with another platoon from another one of the upstream tracks.

In one embodiment the method comprises directing an empty vehicle to a path where the empty vehicle will form a platoon with at least one other empty vehicle.

An advantage of this embodiment is that it is possible to achieve platooning of empty vehicles when the empty vehicles are redistributed in the network, and this will increase track capacity. In an automated vehicle system, such as a PRT system, it may be necessary to redistribute empty vehicles between different stations, if there are more passengers departing vehicles in some stations than there are passengers ascending/arriving at the same station. Empty vehicles will therefore be sent around in the track network in order to comply with the demand for vehicles, and these empty vehicles can advantageously be run in platoons in order to increase the track capacity, since there are no safety requirements to be respected.

In one embodiment the method comprises selecting vehicle destinations so that platoons are formed on the paths, when redistributing empty vehicles in the network.

An advantage of this embodiment is that when redistributing empty vehicles in the network in order to comply with needs and requirements of the passengers, the different vehicle destinations may be selected so that platoons are formed. When forming platoons this way, it is possible to form the longest possible platoons and/or the largest possible number of platoons, because the destination of empty vehicles is selected on the basis that platoons can be formed.

In one embodiment the method further comprises:

defining a merge control zone associated with the merge point, the merge control zone defining at least respective sections of the upstream tracks;

detecting a vehicle entering the merge control zone on a first one of the upstream tracks, the vehicle being a vehicle of a sequence of one or more vehicles approaching the merge point on said first upstream track;

allocating a passage time to the detected vehicle, the passage time being indicative of a time at which the vehicle is scheduled to pass the merge point; allocating the passage time is based on a merge priority assigned to the vehicle according to a predetermined set of merge priority rules;

controlling a speed of the vehicle responsive to the allocated passage time.

It is an advantage of this embodiment that the passage of vehicles is controlled at the merge points, where two or more upstream tracks merge to form one or more downstream tracks. The vehicle passage is controlled by allocating passage times to all vehicles or sequences of vehicles.

The allocation of a passage time may be performed immediately upon detection of the vehicle entering the merge control zone. Alternatively, the allocation of passage time may be later than at the entrance of the merge control zone, as long as the passage time allocation takes place well before the merge in order to ensure safety. If a first upstream track is longer than a second upstream track, the allocation of passage time can thus be delayed, so that vehicles on both the first and the second upstream track receive their passage time allocation at the same distance from the merge point. Otherwise the vehicles on the first upstream track, which is longest, may always get an earlier passage time than the vehicles on the second upstream track. For example, such as situation may occur when the merge control zones are defined such that they cover the entire upstream tracks from the merge to the next upstream node, e.g. the next upstream merge point. Therefore, passage times are allocated at some point upon entrance in the merge control zone and before the merge point.

In some embodiments, the control may even extend beyond the next upstream merge by communication between their respective merge controllers.

Since the assignment of a passage time through the merge point is based on predetermined rules for assigning priorities to different vehicles, the method allows an optimisation of the overall system capacity and/or other overall performance parameters, such as the average passenger travel time.

It is therefore an advantage of the method and system described herein that it provides an increased capacity.

Hence, the vehicle speed and position of a vehicle is controlled within the merge control zone upstream of the merge point so that vehicles can pass through the merge at full speed and at minimum safe spacing.

The passage time may be defined as a point in time, as a time interval, or in any other suitable way.

In embodiments of the method described herein, each vehicle entering a merge control zone is detected and allocated a passage time at some time after having entered the merge control zone and before reaching the merge point.

In some embodiments, the system includes a wayside controller adapted to monitor all vehicles approaching the merge.

In one embodiment the method comprises assigning merge priorities responsive to a load status of the vehicle and at least one other vehicle in the merge control zone.

In one embodiment the method comprises assigning merge priorities so as to form a sequence of vehicles having the same load status. For example, when two streams of vehicles merge into one stream, the merge priorities may be assigned so that a vehicle that enables that two empty vehicles can follow each other is let through. There are no more than two vehicles possible to let through a merge at any time, either the first vehicle on the first upstream track or the first vehicle on the second upstream track. It is an advantage, that the creation of platoons by means of suitable merge priorities may be incorporated in a general framework for merge control.

In one embodiment the method comprises assigning a higher merge priority to an empty vehicle than to a loaded vehicle, when a vehicle passing the merge point directly preceding said empty vehicle is an empty vehicle.

An advantage of this embodiment is that vehicles with the same load status can be grouped together when passing a merge point. The vehicles may come from different upstream tracks of a merge point, and when passage times are assigned to vehicles on the upstream tracks of the merge point, vehicles with the same load status on the same or on different tracks are made to pass the merge point immediately after each other, so that vehicles with the same load status are gathered in groups when running on a downstream track on their way to the next merge point, diverge point, station, etc.

A further advantage of this embodiment is that is enables platooning of empty vehicles, because when an empty vehicle has passed a merge point then another empty vehicle is selected to pass the merge point as long as there are empty vehicles on an upstream track of the merge point.

In one embodiment the method comprises assigning a higher merge priority to a loaded vehicle than to an empty vehicle, when a vehicle passing the merge point directly preceding said loaded vehicle is a loaded vehicle.

In one embodiment the method comprises selecting loaded vehicles to pass the merge point until the at least two upstream tracks have empty vehicles oncoming to the merge point.

An advantage of these embodiments are that when a loaded vehicle has passed the merge point, then loaded vehicles from the two or more upstream tracks are selected to pass the merge point, until there are empty vehicles on all the upstream tracks of the merge point, because then these empty vehicles can be merged into a platoon on the downstream track from the merge point and hence track capacity is increased.

When the same merge priority rules or procedures are applied in following merge points then longer and longer platoons of empty vehicles will be formed.

As the empty vehicles have different destinations the platoons will be splitted again eventually, so that the platoons are dynamically growing and splitting as they move around in the network.

Regarding load status of the vehicle, the load status of a vehicle may be detected in any suitable way. For example, the control system may detect the load status of vehicles based on sensors at stations, e.g. by means of a scale at the exit of a station, or based on sensors at merge points or at diverge points, and/or sensors in the vehicles etc. Alternatively or additionally, load status may be detected by ticketing, e.g. by validation of ticket at the vehicle door or on a station platform.

In some embodiments, the load status of a vehicle may be further specified and/or extended to comprise whether a loaded vehicle carries passengers or other goods.

If a loaded vehicle is defined as being either a vehicle which is loaded with passenger(s) or with goods, there may also be a difference in the safety requirement regarding the load in the vehicle. Safety requirements for vehicles loaded with passengers may be stricter than safety requirements for vehicles loaded with goods. In some embodiments vehicles loaded with goods may be regarded as empty vehicles in relation to safety speed and safety spacing between vehicles, e.g. if the goods are not fragile. In some embodiments vehicles loaded with goods may therefore e.g. be run in platoons in order to increase track capacity in the network.

An operator may decide whether a vehicle loaded with goods should be treated as an empty or a loaded vehicle with respect to safety distance. If a vehicle is loaded with fragile goods, the vehicles may e.g. be treated as a loaded vehicle, whereas the vehicle may be treated as empty, if the goods are not fragile.

The order or command to the vehicle regarding whether it should be treated as loaded or empty may be performed by means of e.g. a ticket, a call command, an information coded to the vehicle at boarding etc. This order or command may define if the load is passengers or goods, and e.g. in the case of goods, the type of goods may also be defined.

In one embodiment the method comprises controlling an empty vehicle to accelerate so as to catch up with an empty vehicle running in front.

An advantage of this embodiment is that an empty vehicle can increase its speed in order to catch up on another empty vehicle running ahead which may be part of a platoon. When the empty vehicle has catched up on the one or more empty vehicles running ahead of it, the vehicle can be part of a platoon of empty vehicles. Since the vehicle is empty and the one or more vehicles running ahead of it is/are empty, safety speed requirements do not need to be complied with, since there is no risk of colliding with loaded vehicles. When an empty vehicle speeds up in order to catch up on empty vehicle (s) ahead, the vehicle reduces the time where it takes up space on the track by accelerating in order to run closer to the empty vehicle ahead. Furthermore, another empty vehicle behind, may also accelerate and so on. All in all more free space on the tracks are released when empty vehicles run closer to each other and run faster in order to catch up on vehicles ahead. So acceleration of empty vehicles has an effect on increasing track capacity.

In one embodiment the method further comprises merging vehicles from a number of upstream tracks into a downstream track, where an empty vehicle has accelerated and thereby provided a gap with free space on the downstream track for accommodating said vehicles from said number of upstream tracks.

The gaps in the vehicle stream created by accelerating empty vehicles can be filled up with vehicles from other tracks by merging, e.g. weaving, of vehicle streams at downstream merges, whereby track capacity is increased.

Acceleration and merging of vehicles result in dynamic forming of platoons, when the vehicles are travelling in the system. It is an advantage to perform dynamic platooning of vehicles en route instead of only performing platooning of vehicles before they start off from a station, because the dynamic platooning allows for an even more increased track capacity.

In one embodiment the method comprises that the automated vehicle system is a personal rapid transit system.

The present invention relates to different aspects including the method described above and in the following, and corresponding systems, devices, and/or product means, each yielding one or more of the benefits and advantages described in connection with the first mentioned aspect, and each having one or more embodiments corresponding to the embodiments described in connection with the first mentioned aspect and/or disclosed in the appended claims.

In particular, disclosed herein is a control system for increasing track capacity in an automated vehicle system, the automated vehicle system comprising a network of tracks along which vehicles are adapted to travel, the network comprising at least one merge point at which at least two upstream tracks merge to form a downstream track, at least one diverge point at which one upstream track diverges to form at least two downstream tracks and a plurality of stations at which passengers may board and/or disembark from the vehicles; wherein the control system comprises:

means for controlling vehicles so as to cause empty vehicles to travel as at least one sequence of empty vehicles; and means for controlling the empty vehicles of the at least one sequence to travel with a first safety distance between each other, the first safety distance being shorter than a second safety distance between vehicles being at least partially loaded.

Advantageous Effects

According to the present invention, it is possible to have more vehicles travelling on the tracks in the network, because the empty vehicles can travel in platoons, and more passengers can therefore be served because of the larger possible number of vehicles on the tracks.

BRIEF DESCRIPTION OF DRAWINGS

The above and/or additional objects, features and advantages of the present invention, will be further elucidated by the following illustrative and non-limiting detailed description of embodiments of the present invention, with reference to the appended drawings, wherein.

MODE FOR THE INVENTION

In the following description, reference is made to the accompanying figures, which show by way of illustration how the invention may be practiced.

Figure 1:
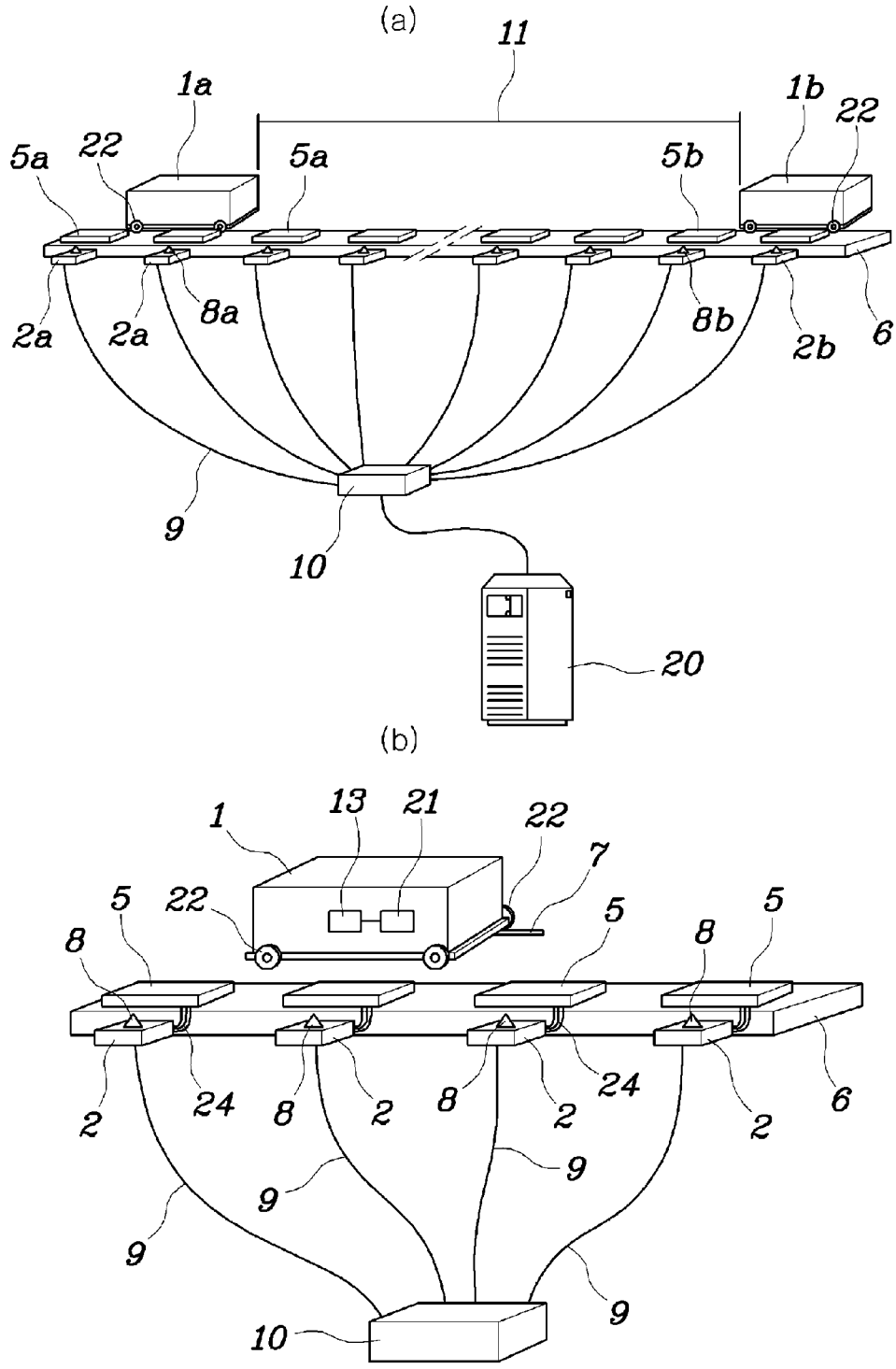
FIG. 1 schematically shows an example of a part of a personal rapid transit system.

FIG. 1 schematically shows an example of a part of a personal rapid transit system with in-track type linear induction motor where the primary cores are positioned along the track. However, it will be understood, that the method of controlling vehicles as described herein may be applied to any kind of track network system where automated vehicles are travelling, and in particular to any kind of PRT system, e.g. on-board systems where the primary cores and motor controllers are placed on board the vehicle.

The personal rapid transit system comprises a track, a section of which is shown in FIG. 1 designated by reference numeral 6. The track typically forms a network, typically including a plurality of merges and diverges. The personal rapid transit system further includes a number of vehicles, generally designated by reference numeral 1. In this example, the vehicles run on wheels along a track by the propelling power of linear induction motors (LIM). Normally each vehicle may carry 3 or 4 passengers, but it is understood that a vehicle can carry more or less passengers. FIG. 1*a* shows a track section 6 with two vehicles 1*a* and 1*b*, while FIG. 1*b* shows an enlarged view of a single vehicle 1. Even though only two vehicles are shown in FIG. 1*a*, it is understood that a personal rapid transit system may include any number of vehicles. Generally, each vehicle typically includes a passenger cabin supported by a chassis or framework carrying wheels 22. An example of a PRT vehicle is disclosed in international patent application WO 04/098970, the entire contents of which are incorporated herein by reference.

The personal rapid transit system of FIG. 1 comprises an in-track type linear induction motor including a plurality of primary cores, generally designated by reference numeral 5, periodically arranged in/along the track 6. In FIG. 1*a* vehicles 1*a* and 1*b* are shown in locations above primary cores 5*a* and 5*b*, respectively. Each vehicle has a reaction plate 7 mounted at a bottom surface of the vehicle. The reaction plate 7 is typically a metal plate made from aluminium, copper, or the like on a steel backing plate.

Each primary core 5 is controlled by a motor controller 2 which supplies a suitable AC power to the corresponding primary core so as to control the thrust for accelerating or decelerating the vehicle. The thrust is imparted by the primary core 5 on the reaction plate 7, when the reaction plate is located above the primary core. To this end, each motor controller 2 includes an inverter or switching device, e.g. a solid state relay (SSR) for switching current (phase angle modulation), that feeds a driving power to the primary core 5. The motor controller 2 controls the voltage/frequency of the driving power in accordance with an external control signal 9. Generally, the electro-magnetic thrust generated between the plate 7 and the primary core 5 is proportional to the area of the air gap between the plate and the primary core, if conditions such as the density and the frequency of flux are the same. Motor controllers may be positioned adjacent to each primary core or in a cabinet which is easier to access for maintenance. In the latter case one motor controller may be switched to control several primary cores.

The system further comprises a plurality of vehicle position detection sensors for detecting the position of the vehicles along the track. In the system of FIG. 1, vehicle position is detected by vehicle position sensors 8, adapted to detect the presence of a vehicle in a proximity of the respective sensors. Even though the vehicle position sensors 8 in FIG. 1 are shown arranged along the track 6 together with the plurality of the primary cores 5, other positions of vehicle position sensors are possible. In particular, each vehicle may include one or more on-board vehicle position detection sensors such that each vehicle transmits position and speed to the motor controllers as measured by the on-board vehicle sensors.

The vehicle position sensors may detect the vehicle presence by any suitable detection mechanism. In preferred embodiments, the vehicle position sensors detect further parameters such as vehicle speed, direction, and/or a vehicle ID.

The term vehicle position detection sensor is meant to refer to any means for detecting the position and speed of vehicles, such as wayside sensors, on-board sensors, in-track sensors etc.

Alternative or additionally, the position and speed of vehicles may be detected by other types of vehicle detection means, e.g. on-board dead reckoning, where the current position of a vehicle is estimated based on a previously determined position and advancing that position based upon known speed, elapsed time and course.

The system further comprises one or more zone controllers 10 for controlling operation of at least a predetermined section or zone of the PRT system. For example, the section controlled by a zone controller may include or constitute a merge control zone of a merge point as described herein. Each zone controller is connected with the subset of the motor controllers 2 within the zone controlled by the zone controller 10 so as to allow data communication between each of the motor controllers 2 with the corresponding zone controller 10, e.g. by means of a wired communication through a point-to-point communication, a bus system, a computer network, e.g. a local area network (LAN), or the like. Alternatively or additionally, the zone controller may be configured to communicate with the motorised vehicles or with track-mounted motors via e.g. a wireless communications channel, e.g. via radio-frequency communications. Even though FIG. 1 only depicts a single zone controller, it is understood that a PRT system normally includes any suitable number of zone controllers. Different parts/zones of the system may be controlled by their respective zone controllers, thereby allowing an expedient scaling of the system as well as providing operation of the individual zones independently of each other. Furthermore, though not depicted in FIG. 1, each zone controller 10 may be constructed as a plurality of individual controllers so as to provide a distributed control over motor controllers in a zone, e.g. the motor controllers of a predetermined part of a track. Alternatively or additionally, a plurality of zone controllers may be provided for each zone so as to enhance the reliability through redundancy, or to provide a direct communication path to different groups of zone controllers.

The zone controller 10—upon receipt of a suitable detection signal from a motor controller indicating the position and the vehicle ID of a detected vehicle—recognizes the position of each vehicle (1;1*a*,1*b*). As an alternative, position and speed can be received directly from the vehicle. The zone controller may maintain a real-time database system with respective records for all vehicles within the zone controlled by the zone controller.

Furthermore, the zone controller computes the distance between two vehicles, as indicated by distance 11 between vehicles 1*a* and 1*b*. The zone controller 10 thus determines respective desired/recommended speeds of the vehicles 1*a*, 1*b* in accordance with the computed distance 11 between the two vehicles, so as to maintain a desired minimum headway or safe distance between vehicles and so as to manage the overall traffic flow within the dedicated zone. The zone controller may thus return information about the free distance and the desired/recommended speed of a detected vehicle to the motor controller at the location at which the vehicle was detected. Alternatively, the zone controller may determine a desired degree of speed adjustment and transmit a corresponding command to the motor controller.

In some embodiments it may be sufficient that the zone controller returns only speed commands to the motor controllers.

In an on-board systems where the primary cores and motor controllers are placed on board the vehicle, the zone controller may communicate information about a free distance and/or speed commands to the vehicle, e.g. via a suitable wireless communications channel.

Alternatively or additionally, speed may also be calculated by the motor controller based on a confirmed free distance. Thus, safe control does not depend on uninterrupted communication with the zone controller, since the motor controller may calculate the speed based on the last known free distance for the vehicle.

The PRT system may further comprise a central system controller 20 connected to the zone controllers 10 so as to allow data communication between the zone controllers and the central system controller 20. The central system controller 20 may be installed in the control center of the PRT system and be configured to detect and control the running state of the overall system, optionally including traffic management tasks such as load prediction, empty vehicle management, passenger information, etc.

Each vehicle 1 may include a vehicle controller, generally designated 13, for controlling operation of the vehicle. In particular, the vehicle controller 13 may control operation of one or more emergency brakes 21 installed in the vehicle 1.

Figure 2:
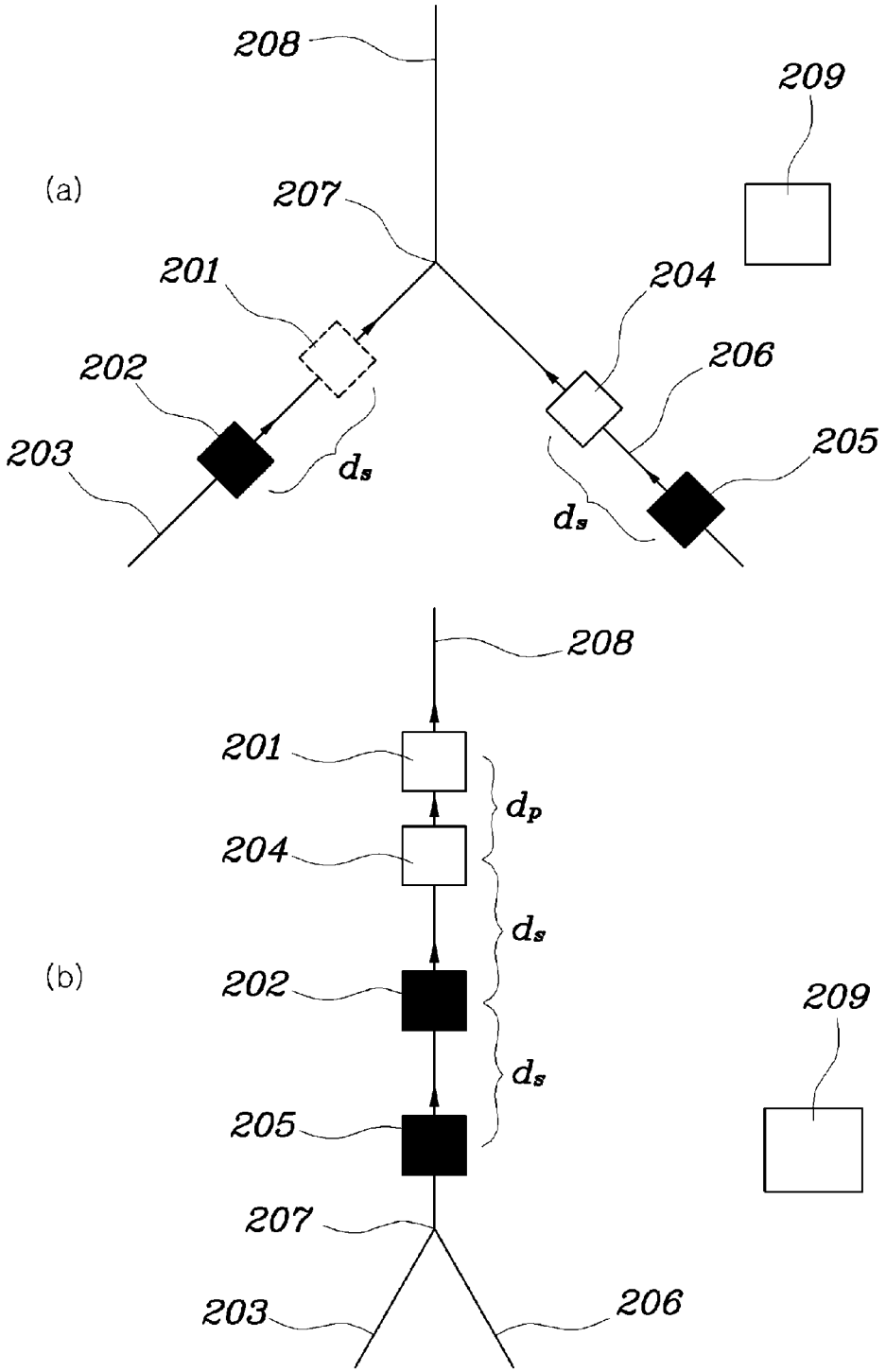
FIG. 2 schematically shows an example of platooning priorities of vehicles at a merge point.

FIG. 2 shows an example of platooning priorities of vehicles. FIG. 2*a* shows vehicles 201, 202 travelling on upstream track 203 and vehicles 204, 205 travelling on upstream track 206.

Vehicles in an automated vehicle system, such as a PRT system, are required to travel with at least a minimum safety distance, $d_s$, to the vehicle ahead in order to ensure safety for passengers. The safety distance is typically a minimum distance which may be predefined based on certain safety requirements. A common requirement is for the safety distance to be large enough to ensure that if one vehicle suddenly stops, the following vehicle can stop before hitting the standing vehicle. However this specific requirement may not always be required, e.g. if the vehicles in a sequence of vehicles are not loaded with passengers, the safety distance does not necessarily need to be as large as when the vehicles are loaded with passengers, but in any case there is some minimum safety distance depending on the conditions and/or circumstances of e.g. the vehicles. The safety distance for travelling vehicles in a track network may depend on the speed of the vehicles, detection delay, brake application delay, acceptable braking rate etc.

After passing the merge point 207 the vehicles 201, 202, 204, 205 will travel on the same downstream track 208, seen in FIG. 2*b*.

Vehicles 201 and 204 are shown to be empty vehicles, indicated by the white fill colour, whereas vehicles 202 and 205 are shown to be loaded, indicated by the black shading colour. The loaded vehicles 202, 205, should have a distance which is at least the safety distance, $d_s$, to the respective vehicles ahead and behind. However, since the vehicles 201, 204 are empty they may travel with a shorter distance to each other than the safety distance, $d_s$, without compromising passenger safety in the system. A sequence of vehicles travelling with a reduced inter-vehicle distance is defined as a platoon, and the inter-vehicle distance in a platoon is called the platooning distance, $d_p$.

FIG. 2 further shows a zone controller 209 controlling the part of the upstream tracks 203 and 206 which are located within a predetermined merge zone (not shown) defined with respect to the merge point 207. For example, the merge zone may be defined so as to cover a certain upstream track section of each upstream track. The lengths of tracks in the merge zone may be selected according to the typical vehicle speeds, typical inter-vehicle distances, braking and acceleration performance of the vehicles, desired smoothness of the changes of vehicle speed and/or other factors.

The merge control unit 209 further assigns a priority value to each vehicle approaching the merge point 207. For example, the merge priorities may be assigned to the vehicles based on information about all vehicles within the zone controlled by the merge controller 209 and, optionally, further based on information about vehicles that are travelling upstream outside the zone controlled by the merge control unit 209. For example, the merge control unit 209 may receive information from one or more other zone controllers, e.g. via a wired or wireless communications link between zone controllers and/or from a central system controller. In alternative embodiments, the priorities may be assigned by a central control unit. In some embodiments, the merge priorities may, once assigned, be changed, e.g. due to changes in the traffic situation. The assignment of merge priorities will be described in more detail in the following.

Based on the assigned priorities, such as the load statuses of vehicles 201, 202, 204, 205 the control unit 209 decides which vehicle should pass through the merge point 207 first, according to the predetermined priorities. The control unit 209 may assign a passage time for each vehicle for passing through the merge point 207.

The speed of the vehicles may have to be adjusted in accordance with the assigned passage times. To this end, in the case of on-board speed control of the vehicles, the merge control unit may communicate the assigned passage time to each vehicle 201, 202, 204, 205 thus allowing the vehicles to adjust their respective speeds. Alternatively, the merge control unit 209 may determine speed commands for causing the vehicles to accelerate or brake by predetermined amounts, and transmit one or more speed commands to each vehicle and/or to motor controllers located along the track. The control unit 209 communicates with the vehicles and/or with track-based motor controllers, e.g. by means of a wireless communication, a point-to-point communication, a computer network, e.g. a local area network (LAN) or the like.

Consequently, by means of the merge control unit 209 speed and position of vehicles can be controlled as far upstream as possible so that vehicles can pass through the merge point at full speed and the allowed minimum safety spacing.

Even though the merge control unit 209 is shown as one device on FIG. 2, it is understood that the merge control unit 209 can comprise one or more parts, in one or more locations. The merge control unit 209 may be one of the zone control units described in connection with FIG. 1. Alternatively, the merge control unit 209 may be a separate unit or a separate functional module integrated in a zone controller. Even though only one merge control unit is shown in FIG. 2, it is understood that the automated vehicle system, e.g. a PRT system, may comprise any suitable number of merge control units. Furthermore, even though only four vehicles, two upstream tracks and one downstream track are shown in the FIG. 2, it is understood that there can be any number of vehicles and any number of tracks at a merge point and in an automated vehicle system, such as a PRT system.

In order to avoid that vehicles from the different upstream tracks 203, 206 collide at the merge point 207 before reaching the common downstream track 208 the merge control unit 207 controls the vehicle speeds of the vehicles, such that the projected distance between vehicles on track 203 and 206 may increase in the merge control zone. The projected distance is the distance as it would have been if all the vehicles were assumed to be travelling on the same upstream track. The increase can be performed by that a vehicle on upstream track 203 travels faster and/or a vehicle on upstream track 206 travels slower or brakes etc. Before vehicles pass the merge point 207 the projected distance between a vehicle on upstream track 203 and a vehicle on upstream track 206 should be increased to the safety distance $d_s$.

A priority rule may further depend on one or more overall system parameters, e.g. an overall performance parameter, indicative of a property of the entire network or a predetermined part of a network, such as a station, a sub-net, a link between two nodes, etc. Consequently, the assignment of priorities may vary over time depending on the overall system performance.

In one embodiment, the assignment of merge priorities takes properties of the upstream links and/or properties of the vehicles travelling on the upstream link into account. Here, the term link refers to the track connecting two nodes of the network, e.g. two merges or diverges.

For example, a merge priority rule may reduce the risk of queues spilling back to the next upstream node where it may block vehicles in other directions. In particular, one example of such a rule takes into account the length of each upstream link of a merge point. For example, the rule may give a higher priority to vehicles approaching the merge point on the upstream link with lowest free capacity. For example, the free capacity of a link/track may be determined as the (maximum) capacity of the link minus the number of vehicles on the link. This rule is particularly useful to avoid congestion in systems near capacity.

Figure 3:
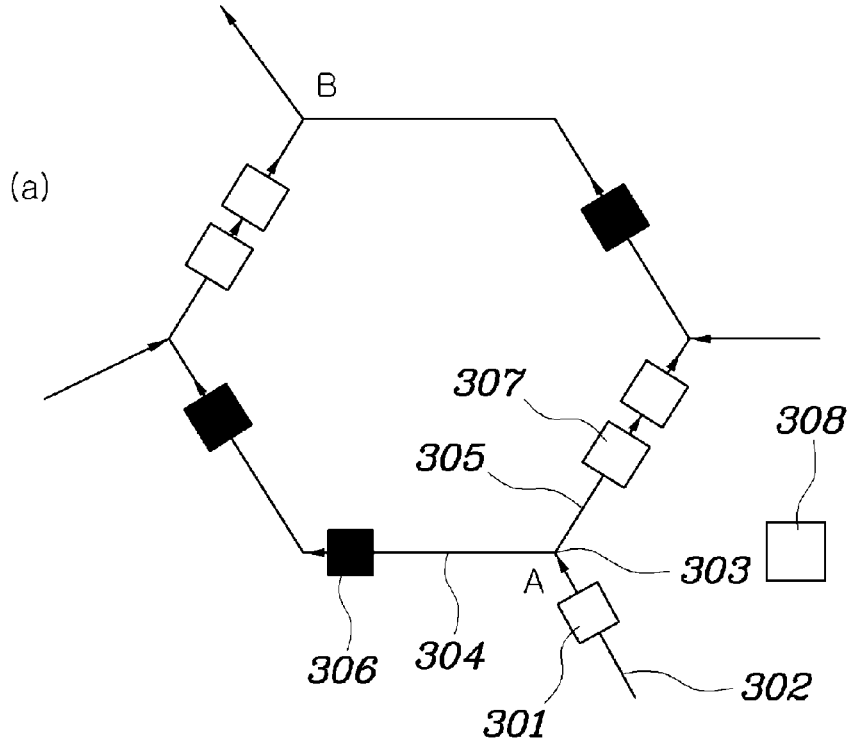
FIG. 3 schematically shows an example of platooning priorities of vehicles at a diverge point.
Figure 3:
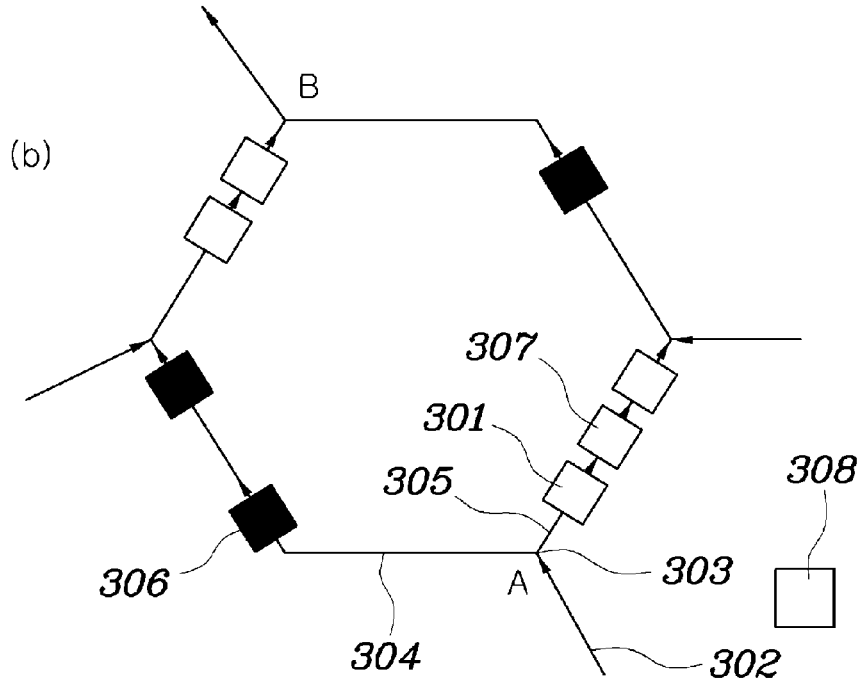

FIG. 3 schematically shows an example of a rule for assigning path priorities to the paths in a system, when there is more than one path between two points A and B that a vehicle at a diverge is about to travel between. The path priorities may be based on the load statuses of the vehicles already travelling on the possible paths. The load status of the vehicle at the diverge, which is about to travel on either of the different paths, is then compared to the load statuses of the vehicles already travelling on the different paths between point A and B. For example, it is possible to assign a higher path priority to a path where most travelling vehicles are empty, and thereby it is possible to control that an empty vehicle in front of a diverge is made to travel on the path where most travelling vehicles are also empty. For example, the control system may detect the load status of vehicles based on sensors at stations, e.g. by means of a scale at the exit of a station, or based on sensors at merge points or at diverge points, and/or sensors in the vehicles etc.

When there are more paths between two points, the path which increases track capacity is chosen.

In FIG. 3*a* the vehicle 301 is travelling on a track 302 towards a diverge point 303, where the track separates into two tracks, 304, 305, each being a different path to the point B where the vehicle 301 is travelling towards from the point A. Both paths defined by track 304 and 305 have a number of vehicles travelling on them. If it is possible to choose a path between point A and B where the vehicle 301 can travel in a platoon with other empty vehicles, this path is chosen by the path directing control system 308. As seen in FIG. 3*a*) the vehicle 306 ahead on track 304 is a loaded vehicle, and therefore the distance between vehicle 306 and vehicle 301 should be the safety distance $d_s$. However, the vehicle 307 ahead on track 305 is en empty vehicle, and therefore the distance between vehicle 307 and vehicle 301 should only be the platooning distance $d_p$. By choosing the path defined by track 305 for transporting vehicle 301, track capacity may be increased, because of the shorter required distance between empty vehicles than between vehicles, where at least one of the vehicles is loaded. Furthermore, the vehicle 301 may reach its destination faster when travelling in a platoon than if travelling on the other path defined by track 304, because the vehicle 301 may accelerate in order to catch up on the empty vehicle ahead.

Figure 4:
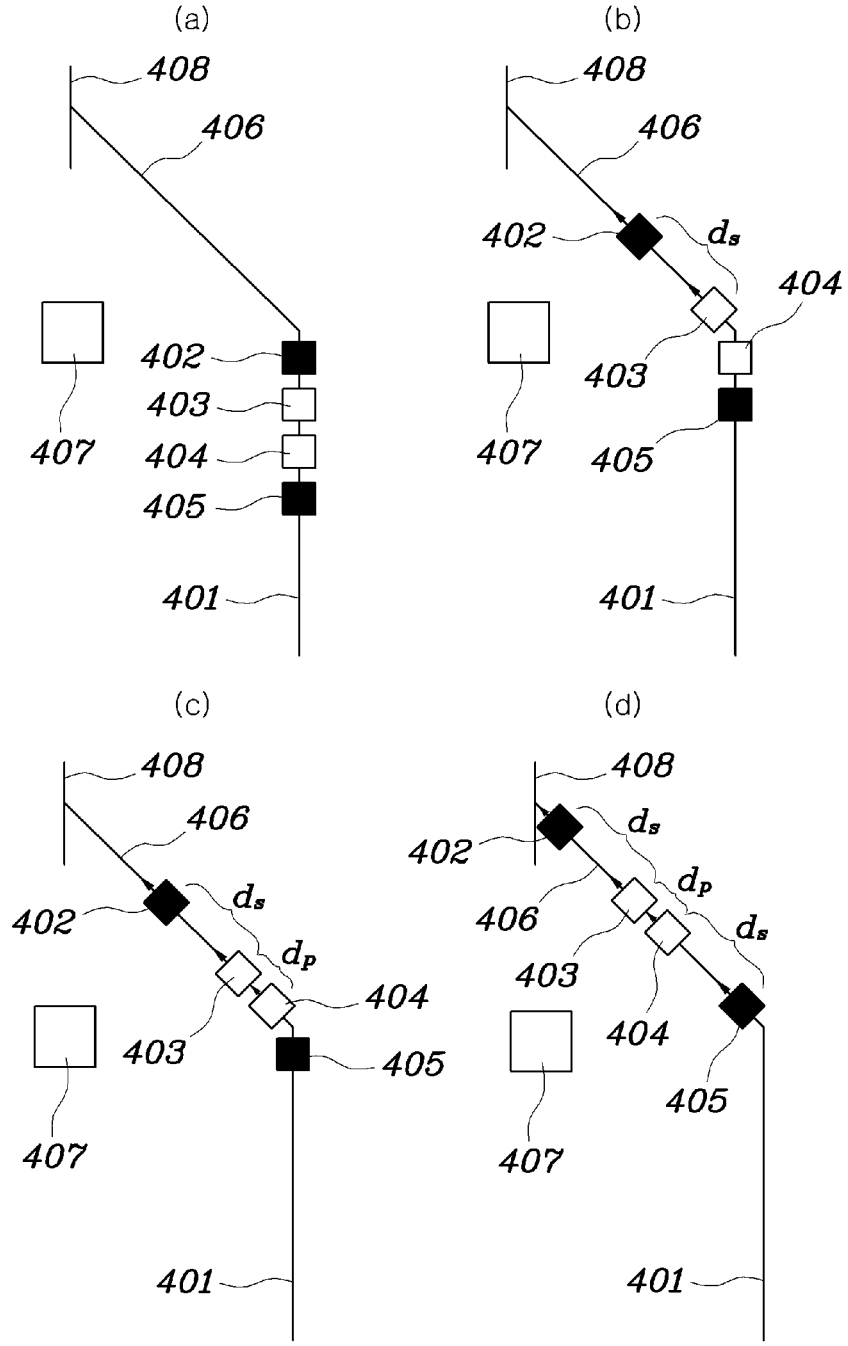
FIG. 4 schematically shows an example of platooning priorities of vehicles dispatching from a station.

FIG. 4 schematically shows an example of a rule for assigning dispatch priorities to vehicles dispatching from a station. The dispatch priorities are based on the load status of the vehicles. For example, a dispatch control system may detect the load status based on sensors at stations, e.g. by means of a scale at the exit of a station, and/or sensors in the vehicles etc.

In FIG. 4 track 401 is the platform at a station at which the vehicles arrive and depart. In FIG. 4*a* four vehicles are standing at the platform and are waiting to depart from the station. The distance between the standing vehicles may be a short distance, e.g. shorter than the safety distance $d_s$, but alternatively the distance between standing vehicles may be larger, e.g. such as the safety distance $d_s$. Two of the vehicles are shown to be occupied with passengers or goods, this is the front vehicle 402 and the rearmost vehicle 405, where the loads are indicated with the black shading colour. Typically, new passengers may embark in the foremost free vehicle standing at the station. The two other vehicles, 403 and 404, are empty, indicated by the white fill colour.

In FIG. 4*b* vehicle 402 and 403 have both departed from the station and are travelling on exit track 406 towards main track 408. The departure times of vehicles 402 and 403 are spaced by means of a safe time headway, since vehicle 402 is loaded, so that these vehicles may have the safety distance $d_s$ upon dispatching from the exit track 406 to the main track 408. The time headway between dispatched vehicles may be the safe time headway, but the distance headway may grow due to acceleration of an empty vehicle on the exit track in order to ensure that the distance between the empty vehicle from the exit track 406 and a loaded vehicle running on the main track 408 may be equal to the safety distance headway. The vehicles from the exit track 406 may have the safety distance when entering the main track 408 at full speed.

The safety distance $d_s$ and/or the platooning distance $d_p$ may be reached at the end of the exit track 406. The exit track 406 may have space for vehicles waiting to depart and an acceleration distance to the main track 408.

In FIG. 4*c* vehicle 404 have also departed from the station and is travelling on exit track 406, and since the control system 407 have detected that both vehicle 403 and 404 are empty, the departure time of vehicle 404 may be adjusted so that the distance between vehicle 403 and 404 is equal to the platooning distance $d_p$, so that vehicles 403 and 404 are travelling in a platoon upon dispatching from the station track 401. Hereby, the vehicles 403 and 404 may have both the platooning distance $d_p$ and may be travelling at full speed when they exit from the exit track 406.

Even though the figure shows that the platooning of vehicle 403 and 404 may be conducted on the exit track 406 when the vehicles depart from the station track 401, since the departure times are adjusted so that these empty vehicles are dispatching having the platooning distance, it is understood that alternatively the platooning of vehicles 403 and 404 may take place when the vehicles dispatch from the exit track 406. In this case, vehicle 404 may accelerate in order to catch up on vehicle 403 on exit track 406. Alternatively, platooning of empty vehicles may take place at the station track 401.

The control of vehicles may be performed by means of controlling departure times, and vehicles may accelerate on the exit track in order to have the correct speed when entering the main track. Vehicles may be standing close together when at the station track, and vehicles may be waiting close together in an exit track, before running into the main track. Controlling vehicles to run in a platoon may depend on the timing of a start command from the control system.

In FIG. 4*d* vehicle 405 has also dispatched from the station track 401 and is now travelling on the exit track 406 from the station, and vehicle 405 is having the safety distance $d_s$ to the vehicle 404 ahead. The empty vehicles 403 and 404 may travel in the platoon as long as they are not loaded.

By making the start time headway between empty vehicles smaller than the start time headway between vehicles, where at least one of the vehicles is loaded, the distance between vehicles may be adjusted to be in accordance with the platooning distance and the safety distance, respectively. Therefore, acceleration of vehicles in order to catch up on an empty vehicle or a platoon ahead may not take place. As a consequence, speed profiles and e.g. acceleration may be same for all vehicles.

Acceleration of empty vehicles on the main track may be performed in order to form platoons, when platoons can not be formed on e.g. exit tracks or at merges.

The dispatch control system 407 may control the dispatching of vehicles from the station by detecting the load status of vehicles.

For example, the dispatch control system may be defined so as to cover a certain track section of a station track and/or an exit track from a station. The dispatch control system may then detect all vehicles arriving at and departing from the station and detect the load status of vehicles and assign dispatch priorities accordingly.

For example, the dispatch control system 407 may receive information from one or more zone controllers in the network, e.g. via a wired or wireless communications link between zone controllers and/or from a central system controller. In alternative embodiments, the dispatch priorities may be assigned by a central control unit. In some embodiments, the dispatch priorities may, once assigned, be changed, e.g. due to changes in the traffic situation.

Even though the dispatch control unit 407 is shown as one device on FIG. 4, it is understood that the merge control unit 407 can comprise one or more parts, in one or more locations. The dispatch control unit 407 may be one of the zone control units described in connection with FIG. 1. Alternatively, the dispatch control unit 407 may be a separate unit or a separate functional module integrated in a zone controller. Even though only one dispatch control unit is shown in FIG. 4, it is understood that the automated vehicle system, e.g. a PRT system, may comprise any suitable number of dispatch control units. Furthermore, even though only four vehicles, one station track and one exit track from the station are shown in the FIG. 4, it is understood that there can be any number of vehicles and any number of tracks to and from a station and in an automated vehicle system, such as a PRT system.

In one embodiment a station may have more than one station track, and there may therefore be more tracks to dispatch vehicles from, which means that vehicles from the different tracks may be merged before travelling on the exit track from the station. This enables that platoons of empty vehicles can also be formed by merging as shown in FIG. 2, and the description in relation to FIG. 2 therefore also applies to this embodiment/situation/case.

Furthermore, the exit track 406 in FIG. 4 may run into a main track, and the stream of vehicles from exit track 406 may merge with the stream of vehicles on the main track by means of the merging method described in relation to FIG. 2.

It will be appreciated that embodiments of the method described herein may use a combination of the above and/or alternative rules, e.g. by calculating weighted sums of priorities calculated according to different rules, and/or by selecting different rules responsive to the overall system performance. For example, when the system operates close to its capacity, different rules may be used than in situations when the system is only sparsely populated by vehicles.

Figure 5:
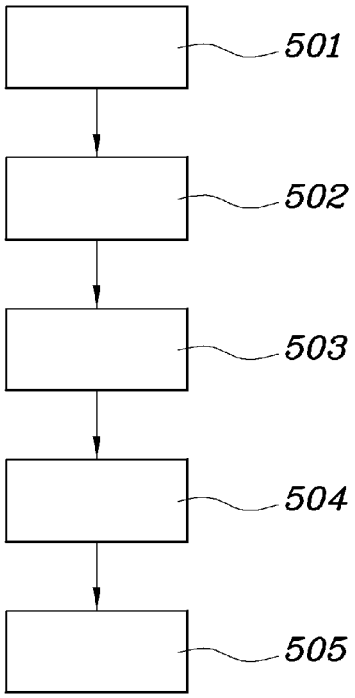
FIG. 5 shows a flowchart of a merge control method.

FIG. 5 shows a flowchart of an example of an overall method of merge control. In step 501 a vehicle travelling towards a merge point on an upstream track in an automated vehicle system, such as a PRT system, is detected to enter a merge control zone of the merge point, e.g. by means of the vehicle communicating with the merge control unit, by means of in-track vehicle sensors detecting the presence of the vehicle, and/or the like. Furthermore, the load status of the vehicle is detected by the merge control unit. In step 502, the control unit calculates an assigned passage time for the vehicle to pass through the merge point, which ensures that there is a predetermined projected safety distance between the vehicle and other vehicles from other upstream tracks which are to pass the same merge point, so that the vehicles do not collide with each other at the merge point. The control unit calculates the passage time in accordance with predetermined merge control priorities as described herein, e.g. based on load status of vehicles. In step 503, the control unit causes the vehicle speed to be adjusted so that the vehicle passes the merge point at the assigned passage time and such that the predetermined safety distance between vehicles is maintained. The vehicle may control its own speed based on the passage time and/or speed commands communicated from the merge controller to the vehicle. Alternatively, the vehicle speed may be controlled by motor control units placed along the track. In step 504 the vehicle is detected to pass the merge point at the assigned passage time having at least the predetermined safety distance to the other vehicles in the merge control zone. If the vehicle was detected to be empty, then in step 505, the control unit checks if the vehicle travelling in front is also empty. If both vehicles are empty, they are controlled to run with a predetermined platooning distance being shorter than the predetermined safety distance applying at the merge. The vehicle may accelerate in order to catch up on the empty vehicle ahead. If both vehicles are not empty, they continue to travel with the predetermined safety distance from the merging. Normal speed control of the vehicle on the downstream track continues afterwards.

Figure 6:
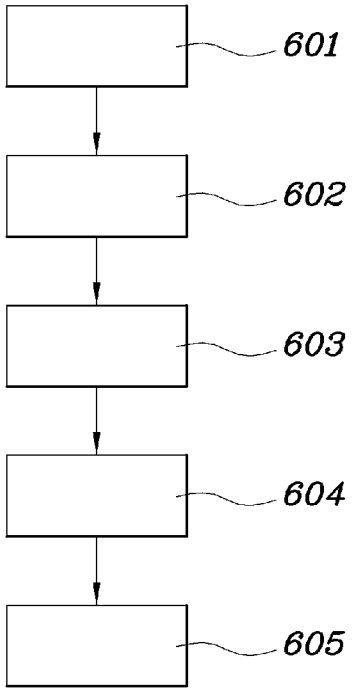
FIG. 6 shows a flowchart of a dispatch control method.

FIG. 6 shows a flowchart of an example of an overall method of controlling dispatching of vehicles from stations. In step 601 a vehicle which has stopped at a station is dispatching from a station on an exit track in an automated vehicle system, such as a PRT system, and is detected to dispatch from the station, e.g. by means of the vehicle communicating with the dispatch control system, by means of in-track vehicle sensors detecting the presence of the vehicle, and/or the like. Furthermore, the load status of the dispatching vehicle is detected by the dispatch control unit, and if the dispatching vehicle is empty, then in step 602, the control unit checks if the vehicle travelling in front of the dispatching vehicle is also empty. If both vehicles are empty, then the control unit ensures that the dispatching vehicle follows the vehicle in front with a predetermined platooning distance being smaller then the safety distance between vehicles, where at least one of the vehicles is loaded. If both vehicles are not empty, the control unit ensures that the dispatching vehicle follows the vehicle in front with the predetermined safety distance for loaded vehicles. In step 603 the control unit calculates the speed with which the dispatching vehicle can travel in order to reach the safety distance to the vehicle in front. If both vehicles are empty, then the dispatching vehicle may accelerate in order to catch up on the vehicle travelling in front. The vehicle may control its own speed based on the speed commands communicated from the dispatch control unit to the vehicle. Alternatively, the vehicle speed may be controlled by motor control units placed along the track. In step 604 the vehicle is detected to have reached the predetermined distance to the vehicle in front. In step 605, normal speed control of the vehicle on the exit track may be undertaken and controlled by some other control unit in the automated vehicle system.

Figure 7:
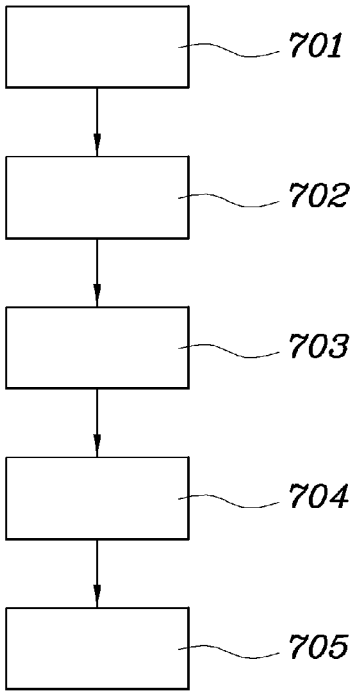
FIG. 7 shows a flowchart of a path control method.

FIG. 7 shows a flowchart of an example of an overall method of controlling path direction of empty vehicles travelling between two points, when there is more than one path in the automated vehicle system between the two points. In step 701 an empty vehicle, which is travelling on a track towards a diverge point from where there are two paths to the destination point, is detected to enter the diverge point, e.g. by means of the vehicle communicating with the control system, by means of in-track vehicle sensors detecting the presence of the vehicle, and/or the like. In step 702, the control unit determines if one of the vehicles travelling in front of the empty vehicle on one of the at least two tracks leading to the destination point is also empty. If one of the vehicles in front travelling on one of the tracks is also empty, then the control unit ensures that the empty vehicle is made to travel on the same track. If no one of the vehicles travelling in front of the empty vehicle on any of the tracks is empty, the control unit chooses which path the empty vehicle should travel according to other conditions/rules than the load status. In step 703 the control unit calculates the speed with which the empty vehicle can travel in order to reach a predetermined distance to the vehicle in front. If both vehicles are empty, then the vehicle may accelerate in order to catch up on the vehicle travelling in front. The control system ensures that the vehicle follows the vehicle in front with a predetermined platooning distance being smaller then the predetermined safety distance between vehicles, where at least one of the vehicles is loaded. If no one of the vehicles travelling in front of the empty vehicle is empty, the control unit ensures that the empty vehicle follows a vehicle in front with the predetermined safety distance for loaded vehicles. The vehicle may control its own speed based on the speed commands communicated from the control unit to the vehicle. Alternatively, the vehicle speed may be controlled by motor control units placed along the track. In step 704 the vehicle is detected to have reached the predetermined distance to the vehicle in front. In step 705, normal speed control of the vehicle on the exit track may be undertaken and controlled by some control unit in the automated vehicle system.

The method and control systems described herein and, in particular, the vehicle controller, merge/zone controller, and motor controller described herein can be implemented by means of hardware comprising several distinct elements, and by means of a suitably programmed microprocessor or other processing means. The term processing means comprises any circuit and/or device suitably adapted to perform the functions described herein, e.g. caused by the execution of program code means such as computer-executable instructions. In particular, the above term comprises general- or special-purpose programmable microprocessors, Digital Signal Processors (DSP), Application Specific Integrated Circuits (ASIC), Programmable Logic Arrays (PLA), Field Programmable Gate Arrays (FPGA), special purpose electronic circuits, etc., or a combination thereof.

In the device claims enumerating several means, several of these means can be embodied by one and the same item of hardware, e.g. a suitably programmed microprocessor, one or more digital signal processor, or the like. The mere fact that certain measures are recited in mutually different dependent claims or described in different embodiments does not indicate that a combination of these measures cannot be used to advantage.

Although some embodiments have been described and shown in detail, the invention is not restricted to them, but may also be embodied in other ways within the scope of the subject matter defined in the following claims. In particular, it is to be understood that other embodiments may be utilised and structural and functional modifications may be made without departing from the scope of the present invention.

In particular, embodiments of the invention have mainly been described in connection with an in-track PRT system. However, it will be appreciated that other PRT systems, e.g. on-board PRT systems, and other propulsion systems, as well as automated vehicle systems other than PRT systems may be applied in connection with the present invention.

It should be emphasized that the term "comprises/comprising" when used in this specification is taken to specify the presence of stated features, integers, steps or components but does not preclude the presence or addition of one or more other features, integers, steps, components or groups thereof.

The invention claimed is:

1. A method of increasing track capacity in an automated vehicle system, the automated vehicle system comprising a network of tracks along which vehicles are adapted to travel, the network comprising at least one merge point at which at least two upstream tracks merge to form a downstream track, at least one diverge point at which one upstream track diverges to form at least two downstream tracks and a plurality of stations at which passengers may board and/or disembark from the vehicles;

wherein the method comprises controlling vehicles so as to cause empty vehicles to travel as at least one sequence of empty vehicles; and controlling the empty vehicles of the at least one sequence to travel with a first safety distance between each other, the first safety distance being shorter than a second safety distance between vehicles being at least partially loaded;

wherein controlling the empty vehicles comprises dynamically forming said sequence of vehicles;

defining a merge control zone associated with the merge point, the merge control zone defining at least respective sections of the upstream tracks;

detecting a vehicle entering the merge control zone on a first one of the upstream tracks, the vehicle being a vehicle of a sequence of one or more vehicles approaching the merge point on said first upstream track;

allocating a passage time to the detected vehicle, the passage time being indicative of a time at which the vehicle is scheduled to pass the merge point; allocating the passage time is based on a merge priority assigned to the vehicle according to a predetermined set of merge priority rules; and controlling a speed of the vehicle responsive to the allocated passage time.

2. A method according to claim 1, wherein the method comprises assigning merge priorities responsive to a load status of the vehicle and at least one other vehicle in the merge control zone.

3. A method according to claim 2, wherein the method comprises assigning merge priorities so as to form a sequence of vehicles having the same load status.

4. A method according to claim 1, wherein the method comprises assigning a higher merge priority to an empty vehicle than to a loaded vehicle, when a vehicle passing the merge point directly preceding said empty vehicle is an empty vehicle.

5. A method according to claim 1, wherein the method comprises assigning a higher merge priority to a loaded vehicle than to an empty vehicle, when a vehicle passing the merge point directly preceding said loaded vehicle is a loaded vehicle.

6. A method according to claim 5, wherein the method comprises selecting loaded vehicles to pass the merge point until the at least two upstream tracks have empty vehicles oncoming to the merge point.

7. A method according to claim 1, wherein the method comprises controlling an empty vehicle to accelerate so as to catch up with an empty vehicle running in front.

8. A method according to claim 7, wherein the method further comprises merging vehicles from a number of upstream tracks into a downstream track, where an empty vehicle has accelerated and thereby provided a gap with free space on the downstream track for accommodating said vehicles from said number of upstream tracks.

9. A method according to claim 1, wherein the method comprises assigning a path priority to a path at diverges at which more than one path leads to a destination of a vehicle, wherein assigning the path priority comprises assigning a higher path priority to a path responsive to a load status of respective previous vehicles travelling along the more than one paths.

10. A method according to 9, wherein the method comprises directing an empty vehicle to a path where the empty vehicle will form a platoon with at least one other empty vehicle.

11. A method according to claim 9, wherein the method comprises selecting vehicle destinations so that platoons are formed on the paths, when redistributing empty vehicles in the network.

12. A method according to claim 1, the method comprises assigning dispatch priorities to vehicles scheduled to be dispatched from a station, wherein dispatch priorities are assigned responsive to the load status of the vehicles.

13. A method according to claim 12, wherein the method comprises dispatching a sequence of at least two empty vehicles together in a platoon, the dispatching time being a scheduled dispatching time assigned to the front vehicle in the sequence of the at least two empty vehicles.

14. A method according to claim 12, wherein the method comprises selecting an empty vehicle to be dispatched in a sequence of empty vehicles, as long as there are empty vehicles at the station to be dispatched.

15. A method according to claim 12, wherein the method comprises selecting a loaded vehicle to be dispatched in a sequence of loaded vehicles, as long as there are loaded vehicles at the station to be dispatched.

16. A method according to claim 1, wherein the automated vehicle system is a personal rapid transit system.

17. A method according to claim 1, wherein the method comprises controlling an empty vehicle to accelerate so as to catch up with an empty vehicle running in front.

18. A control system for increasing track capacity in an automated vehicle system, the automated vehicle system comprising a network of tracks along which vehicles are adapted to travel, the network comprising at least one merge point at which at least two upstream tracks merge to form a downstream track, at least one diverge point at which one upstream track diverges to form at least two downstream tracks and a plurality of stations at which passengers may board and/or disembark from the vehicles; wherein the control system comprises:

means for controlling vehicles so as to cause empty vehicles to travel as at least one sequence of empty vehicles; and means for controlling the empty vehicles of the at least one sequence to travel with a first safety distance between each other, the first safety distance being shorter than a second safety distance between vehicles being at least partially loaded;

wherein means for controlling the empty vehicles comprises means dynamically forming said sequence of vehicles;

means for defining a merge control zone associated with the merge point, the merge control zone defining at least respective sections of the upstream tracks;

means for detecting a vehicle entering the merge control zone on a first one of the upstream tracks, the vehicle being a vehicle of a sequence of one or more vehicles approaching the merge point on said first upstream track;

means for allocating a passage time to the detected vehicle, the passage time being indicative of a time at which the vehicle is scheduled to pass the merge point; allocating the passage time is based on a merge priority assigned to the vehicle according to a predetermined set of merge priority rules; and means for controlling a speed of the vehicle responsive to the allocated passage time.

* * * * *

UNITED STATES PATENT AND TRADEMARK OFFICE

CERTIFICATE OF CORRECTION

PATENT NO. : 8,682,511 B2
APPLICATION NO. : 12/994547
DATED : March 25, 2014
INVENTOR(S) : Andreasson It is certified that error appears in the above-identified patent and that said Letters Patent is hereby corrected as shown below:

On the Title Page of the Patent, Column 2, Item [57] Abstract, Line 5, delete "up stream" and insert -- upstream --

On the Title Page of the Patent, Column 2, Item [57] Abstract, Line 7, delete "down-stream" and insert -- downstream --

In the Claims

Column 20, Line 43, Claim 10, delete "9" and insert -- claim 9 --

Signed and Sealed this
Twenty-fourth Day of June, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,682,511 B2
APPLICATION NO. : 12/994547
DATED : March 25, 2014
INVENTOR(S) : Ingmar Andreasson It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 764 days.

Signed and Sealed this
Twenty-ninth Day of September, 2015

Michelle K. Lee

Michelle K. Lee
*Director of the United States Patent and Trademark Office*